United States Patent [19]

Noguchi et al.

[11] Patent Number: 4,571,380

[45] Date of Patent: Feb. 18, 1986

[54] SPECTRALLY SENSITIZED INNER LATENT IMAGE TYPE SILVER HALIDE PHOTOGRAPHIC EMULSIONS

[75] Inventors: Yasuhiro Noguchi; Yuji Mihara, both of Kanagawa, Japan

[73] Assignee: Fuji Photo Film Co., Ltd., Kanagawa, Japan

[21] Appl. No.: 546,214

[22] Filed: Oct. 27, 1983

[30] Foreign Application Priority Data

Oct. 27, 1982 [JP] Japan ..... 57-188595

[51] Int. Cl.[4] ..... G03C 1/02; G03C 1/08

[52] U.S. Cl. ..... 430/589; 430/574; 430/409; 430/940; 430/598

[58] Field of Search ..... 430/574, 576, 589, 548, 430/940, 409

[56] References Cited

U.S. PATENT DOCUMENTS

| | | | |
|---|---|---|---|
| 3,580,724 | 5/1971 | Sato et al. | 430/574 |
| 3,772,030 | 11/1973 | Gilman et al. | 430/589 |
| 4,040,839 | 8/1977 | Matsuyama et al. | 430/574 |
| 4,362,813 | 12/1982 | Mihara et al. | 430/574 |

*Primary Examiner*—Won H. Louie

*Attorney, Agent, or Firm*—Sughrue, Mion, Zinn, Macpeak, and Seas

[57] ABSTRACT

An inner latent image type silver halide photographic emulsion which is spectrally sensitized by adding at least one cyanine dye represented by general formula (II) to a direct positive inner latent image type silver halide photographic emulsion and thereafter adding additionally at least one cyanine dye represented by general formula (I) to said emulsion (I)

(II)

(the symbols are as defined in the appended claims). A remarkable increase of spectral sensitivity, an increase of maximum density and a decrease of minimum density can be obtained by this silver halide photographic emulsion.

12 Claims, No Drawings

SPECTRALLY SENSITIZED INNER LATENT IMAGE TYPE SILVER HALIDE PHOTOGRAPHIC EMULSIONS

FIELD OF THE INVENTION

The present invention relates to silver halide photographic emulsions, particularly to spectrally sensitized inner latent image type silver halide photographic emulsions.

BACKGROUND OF THE INVENTION

Processes for obtaining direct positive images which comprise carrying out a surface treatment of an inner latent image type silver halide photographic emulsion in the presence of a nucleus forming agent and photographic emulsions and light-sensitive materials used for such processes are disclosed in U.S. Pat. Nos. 2,456,953, 2,497,875, 2,497,876, 2,588,982, 2,675,318 and 3,227,552, British Pat. No. 1,151,363, Japanese Patent Publication No. 29405/68, U.S. Pat. No. 2,592,250 and British Pat. No. 1,011,062, etc.

The term "inner latent image type silver halide photographic emulsion" means a silver halide photographic emulsion having sensitive nuclei which are mainly present in the inner part of the silver halide particles so that latent images are mainly formed in the inner part of the silver halide particles based on such inner sensitive nuclei. Using such inner latent image type silver halide photographic emulsions, positive images can be directly obtained by carrying out surface development in the presence of a nucleus forming agent which is contained in the sensitive material or in a processing solution after imagewise exposed to light.

In silver halide photographic light-sensitive materials, silver halide photograhic emulsions are generally spectrally sensitized. Particularly in color light-sensitive materials, spectral sensitization is necessary to obtain a green-sensitive layer and a red-sensitive layer together with a layer which is sensitive to blue light. As useful sensitizing dyes, there are those described in, for example, German Pat. No. 929,080, U.S. Pat. Nos. 2,493,748, 2,503,776, 2,519,001, 2,912,329, 3,656,959, 3,672,897, 3,694,217, 4,025,349 and 4,046,572, British Pat. No. 1,242,588 and Japanese Patent Publication Nos. 14030/69 and 24844/77.

These sensitizing dyes may be used alone or combinations thereof may be used. Combinations of sensitizing dyes are frequently used for supersensitization. Typical examples thereof are described in U.S. Pat. Nos. 2,668,545, 2,977,229, 3,397,060, 3,522,052, 3,527,641, 3,617,293, 3,628,964, 3,666,480, 3,672,898, 3,679,428, 3,703,377, 3,814,609, 3,837,862 and 4,026,707, British Pat. Nos. 1,344,281 and 1,507,803, Japanese Patent Publication Nos. 4936/68 and 12375/78 and Japanese Patent Application (OPI) Nos. 110618/77 and 109925/77 (the term "OPI" as used herein refers to a "published unexamined Japanese patent application").

With combinations of sensitizing dyes as described above, since dyes having different absorption wavelength are generally combined, the resultant color sensitization region is expanded in many cases as compared with the case of using one sensitizing dye. Further, if a sensitizing dye is used alone in a large amount, sufficient sensitivity cannot be obtained and frequently there is caused an increase of the minimum image density or a decrease of the maximum image density.

Further, as described in P. B. Gilman, Jr., *Photogr. Sci. Eng.*, 20(3), 97 (1976) and U.S. Pat. No. 3,622,316, it has been attempted to obtain higher sensitivity by adsorbing sensitizing dyes onto silver.halide particles so as to form layers. According to such methods, "dye positive holes" formed in an inner dye layer as transferred to the dye in an outer dye layer and/or light energy (or photoelectrons) formed on the outer dye layer is transferred to the silver halide through the inner dye layer. In these cases, there is a restriction on the energy level of dyes adsorbed in the form of layers and, in the case that the lower or inner layer is a cationic dye and the upper or outer layer is an anionic dye as proposed by P. B. Gilman, Jr., sensitivity does not increase, rather is deteriorated, when a surface treatment is carried out in the presence of a nucleus forming agent to obtain direct positive images. Further, in the case of U.S. Pat. No. 3,622,316, there are the disadvantages that not only is the increase of sensitivity insufficient but also the sensitization wavelength region is unnecessarily expanded because of using a combination of dyes having different wavelengths, and, consequently, sharp color images cannot be obtained.

SUMMARY OF THE INVENTION

The first object of the present invention is to provide inner latent image type silver halide photographic emulsions having high spectral sensitivity, and the second object of the present invention is to provide color diffusion transfer sensitive materials having high maximum density and low minimum density.

The present inventors unexpectedly found that desirable photographic effects, namely, a remarkable increase of spectral sensitivity, an increase of maximum density and a decrease of minimum density can be obtained by adding at least one cyanine dye represented by the following general formula (II) to a direct positive inner latent image type silver halide photographic emulsion and, thereafter, additionally adding at least one cyanine dye represented by the following general formula (I) to the emulsion.

Such photographic effects are particularly remarkable in inner latent image type silver halide photographic emulsions in which direct positive images can be obtained by surface development in the presence of a nucleus forming agent.

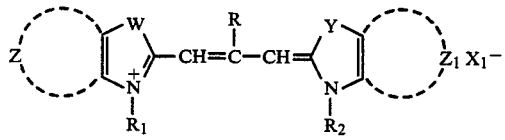

(I)

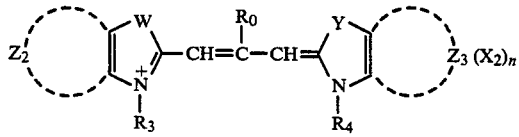

(II)

In these formulae, W and Y, which may be identical or different, each represents an oxygen atom, a selenium atom, a sulfur atom or $>N\text{-}R_5$. $R_5$ represents a lower alkyl group which is unsubstituted or substituted with a halgen atom or a lower alkoxyl group having preferably up to 5 carbon atoms (for example, a methyl group, an ethyl group, a propyl group, a butyl group, a methoxyethyl group or a 2-chloroethyl group, etc.) or an allyl group. The lower alkyl group as $R_5$ preferably contains up to 5 carbon atoms.

Z, $Z_1$, $Z_2$ and $Z_3$ each represents an atomic group necessary to form a benzene ring or a naphthalene ring which may be substituted with, for example, a lower alkyl group, a lower alkoxyalkyl group, an aryl group, a carboxyl group, an alkoxycarbonyl group, a hydroxyl group or a halogen atom. Z, $Z_1$, $Z_2$ and $Z_3$ each forms together with W, Y and the nitrogen atom a benzimidazole nucleus (for example, a 5,6-dichlorobenzimidazole nucleus, a 5-chloro-6-trifluoromethylbenzimidazole nucleus, etc.), a benzoxazole nucleus (for example, a benzoxazole nucleus, a 5-chlorobenzoxazole nucleus, a 5-methylbenzoxazole nucleus, a 5-bromobenzoxazole nucleus, a 5-fluorobenzoxazole nucleus, a 5-phenylbenzoxazole nucleus, a 5-methoxybenzoxazole nucleus, a 5-ethoxybenzoxazole nucleus, a 5-trifluoromethylbenzoxazole nucleus, a 5-hydroxybenzoxazole nucleus, a 5-carboxybenzoxazole nucleus, a 6-methylbenzoxazole nucleus, a 6-chlorobenzoxazole nucleus, a 6-methoxybenzoxazole nucleus, a 6-hydroxybenzoxazole nucleus or a 5,6-dimethylbenzoxazole nucleus, (etc.), a benzothiazole nucleus (for example, a benzothiazole nucleus, a 4-chlorobenzothiazole nucleus, a 5-chlorobenzothiazole nucleus, a 6-chlorobenzothiazole nucleus, a 7-chlorobenzothiazole nucleus, a 4-methylbenzothiazole nucleus, a 5-methylbenzothiazole nucleus, a 6-methylbenzothiazole nucleus, a 5-bromobenzothiazole nucleus, a 6-bromobenzothiazole nucleus, a 4-phenylbenzothiazole nucleus, a 5-phenylbenzothiazole nucleus, a 5-methoxybenzothiazole nucleus, a 6-methoxybenzothiazole nucleus, a 5-ethoxybenzothiazole nucleus, a 5-carboxybenzothiazole nucleus, a 5-ethoxybenzothiazole nucleus, a 5-fluorobenzothiazole nucleus, a 5-ethoxycarbonylbenzothiazole nucleus, a 5-chloro-6-methylbenzothiazole nucleus, a 5-hydroxy-6-methylbenzothiazole nucleus or a 5,6-dimethylbenzothiazole nucleus, etc.), a benzoselenazole nucleus (for example, a benzoselenazole nucleus, a 5-chlorobenzoselenazole nucleus, a 5-methoxybenzoselenazole nucleus, a 5-hydroxybenzoselenazole nucleus or a 5-phenylbenzoselenazole nucleus, etc.), a naphthoxazole nucleus (for example, a naphtho[2,1-d]-oxazole nucleus, a naphtho[1,2-d]oxazole nucleus, a naphtho[2,3-d]oxazole nucleus, a 5-methoxynaphtho[1,2-d]-oxazole nucleus, etc.), a naphthothiazole nucleus (for example, a naphtho[2,1-d]thiazole nucleus, a naphtho-[1,2-d]thiazole nucleus, a naphtho[2,3-d]thiazole nucleus, a 5-methoxynaphtho[1,2-d]thiazole nucleus, a 7-ethoxynaphtho[2,1-d]thiazole nucleus, an 8-methoxynaphtho-[2,3-d]thiazole nucleus or an 8-chloronaphtho[1,2-d]-thiazole nucleus, etc.), or a naphthoselenazole nucleus (for example, a naphtho[2,1-d]selenazole nucleus, a naphtho[1,2-d]selenazole nucleus, a naphtho[2,3-d]-selenazole nucleus or an 8-chloronaphtho[1,2-d]selenazole nucleus, etc.).

R and $R_0$ each represents a hydrogen atom a lower alkyl group (for example, a methyl group, an ethyl group or a propyl group, etc.), a phenyl group or an aralkyl group (for example, a benzyl group or a phenethyl group, etc.). The lower alkyl group preferably contains up to 8 carbon atoms.

$R_1$ and $R_2$ each represents an alkyl group (for example, a methyl group, an ethyl group, a propyl group or a butyl group, etc.), a haloalkyl group (for example, a 2,2,3,3-tetrafluoropropyl group, a 2-fluoroethyl group or a 2-chloroethyl group, etc.), an alkoxyalkyl group (for example, a methoxyethyl group, etc.), an aralkyl group (for example, a phenethyl group or a phenylpropyl group, etc.), an aryloxyalkyl group (for example, a phenoxyethyl group or a phenoxypropyl group, etc.) or an allyl group. The alkyl group, the haloalkyl group, the aralkyl group, the alkoxyalkyl group and the aryloxyalkyl group as $R_1$ and $R_2$ preferably include an alkyl group having up to 8 carbon atoms.

$R_3$ and $R_4$ each represents an alkyl group substituted with a carboxyl group or a sulfo group. The substituent carboxyl group or sulfo group may be connected with the alkyl group through another divalent group such as an arylene group and an alkylene oxide group. The alkyl group substituted with a carboxyl group or a sulfo group may be substituted with another substituent such as a hydroxyl group and an acyloxy group. As examples of $R_3$ and $R_4$, there are a carboxymethyl group, a 2-carboxyethyl group, a 3-carboxypropyl group, a 4-carboxybutyl group, a (2-carboxyethoxy)ethyl group, a p-carboxybenzyl group, a 2-sulfoethyl group, a 3-sulfopropyl group, a 4-sulfobutyl group, a 2-hydroxy-3-sulfopropyl group, a 2-(2-sulfoethoxy)ethyl group, a 2-(3-sulfopropoxy)ethyl group, a 2-acetoxy-3-sulfopropyl group, a 3-methoxy-2-(3-sulfopropoxy)propyl group, a 2-[2-(3-sulfopropoxy)ethoxy]ethyl group, a 2-hydroxy-3-(3'-sulfopropoxy)propyl group, a p-sulfobenzyl group or a p-sulfophenethyl group, etc. At least one of $R_3$ and $R_4$ represents an alkyl group substituted with a sulfo group. The alkyl group as $R_3$ and $R_4$ preferably contains up to 8 carbon atoms.

$X_1$ represents an anion, $X_2$ represents a cation, and n is 0 or 1. When both $R_3$ and $R_4$ are anionic groups (for example, a —COO— *group or an* $-SO_3-$ group), $X_2$ is a cation and n is 1.

As a cation of $X_2$, there are, for example, an alkali metal ion such as $Na^+$, $K^+$ or $Li^+$ and an organic ammonium ion such as quaternary ammonium ion derived from a triethylamine or a pyridine.

DETAILED DESCRIPTION OF THE INVENTION

In the following, examples of sensitizing dyes represented by general formula (I) and sensitizing dyes represented by general formula (II) used in the present invention are described, wherein (I*a*) and (II*a*), (I*b*) and (II*b*), (I*c*) and (II*c*), (I*d*) and (II*d*), (I*e*) and (II*e*), (I*f*) and (II*f*), (I*g*) and (II*g*), (I*h*) and (II*h*), and (I*i*) and (II*i*) are each used as combinations thereof.

Ia (1)

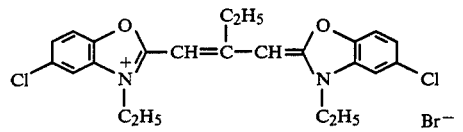

(2)

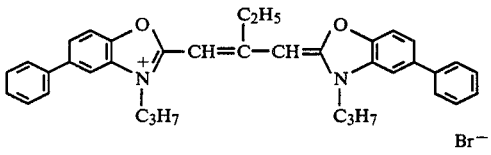

(3)

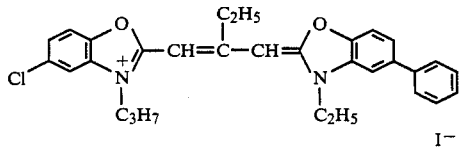

-continued
Ib (4)
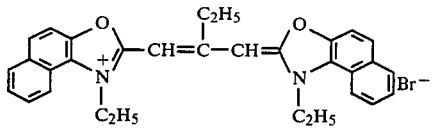
(5)
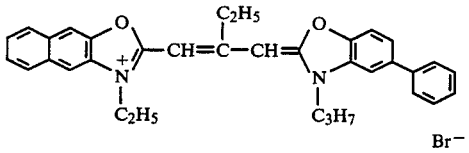
Ic (6)
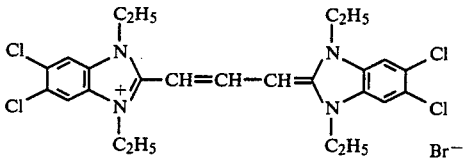
(7)
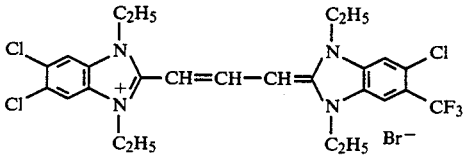
Id (8)
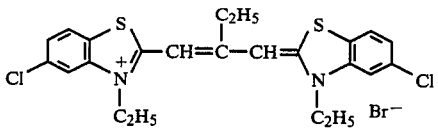
(9)
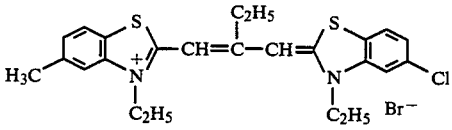
(10)
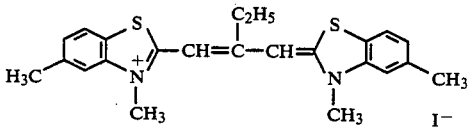
(11)
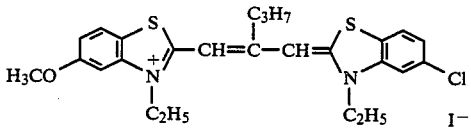
(12)
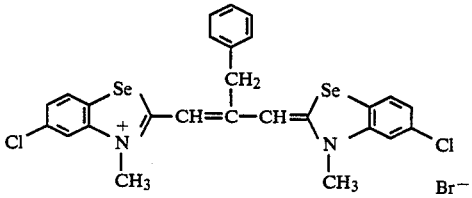
Ie (13)
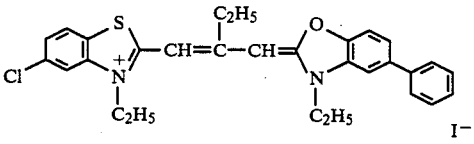
-continued
(14)
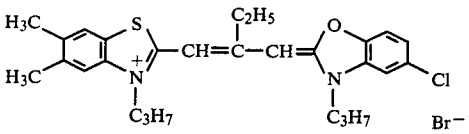
(15)
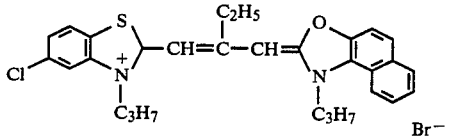
(15a)
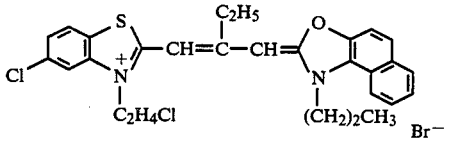
If (16)
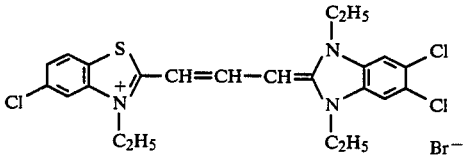
(17)
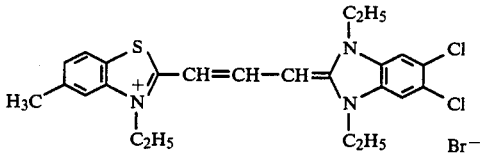
(18)
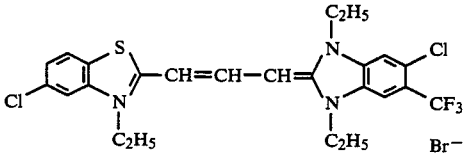
(18a)
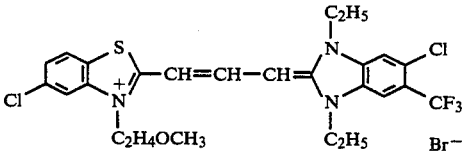
Ig (19)
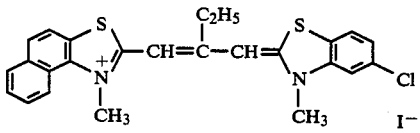
(20)
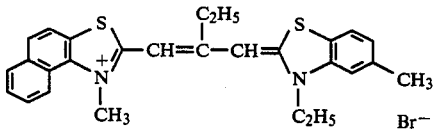
(21)
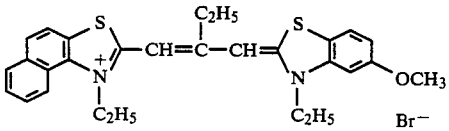

-continued
(22)
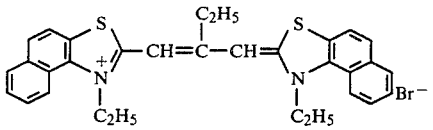
(23)
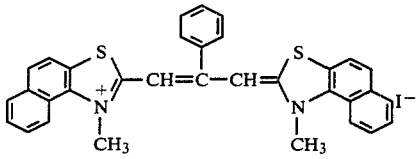
(24)
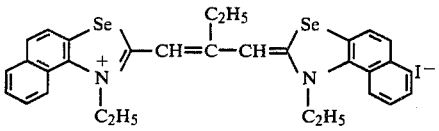
Ih
(25)
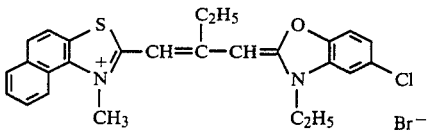
(26)
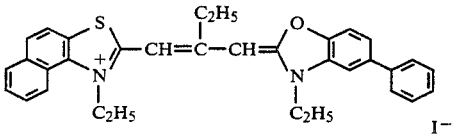
(27)
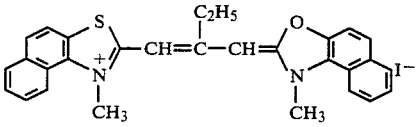
Ii
(28)
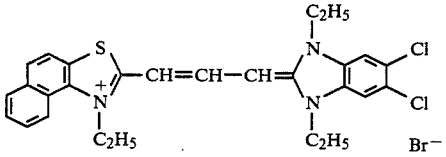
(29)
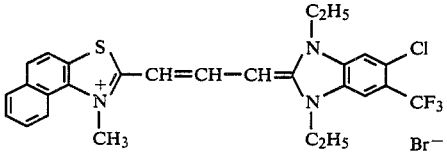
(30)
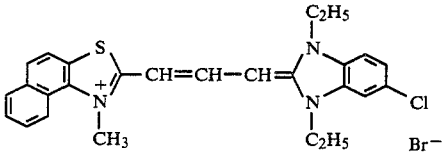
IIa
(1)
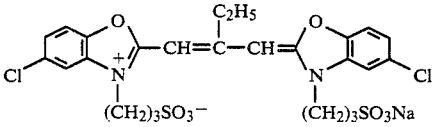
-continued
(2)
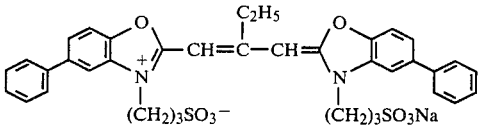
(3)
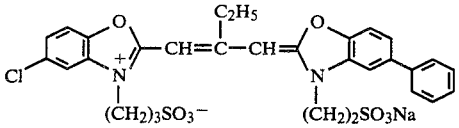
(4)
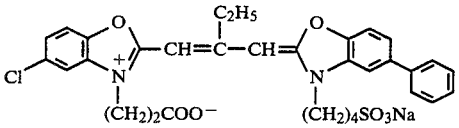
IIb
(5)
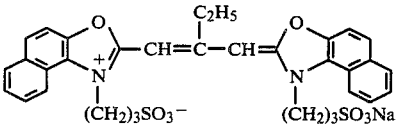
(6)
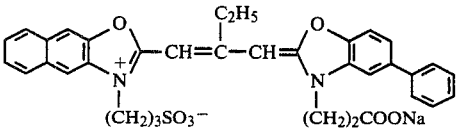
(7)
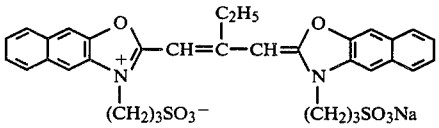
IIc
(8)
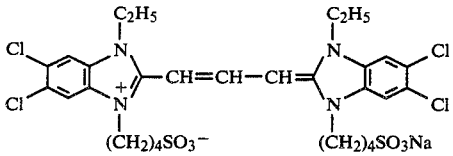
(9)
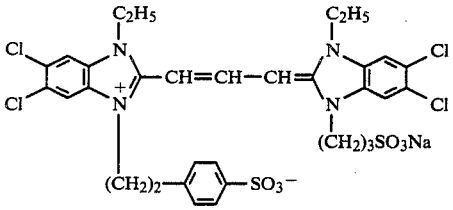
(10)
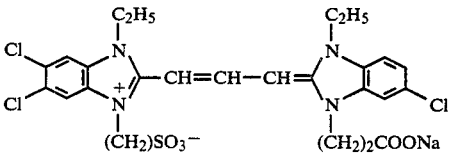
(11)
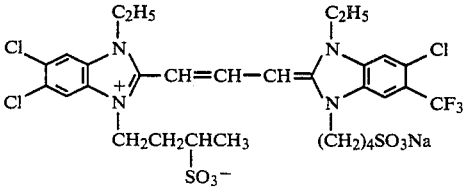
IId -continued
(12)
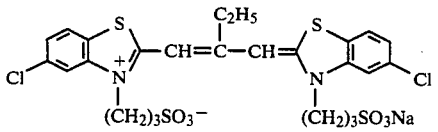
(13)
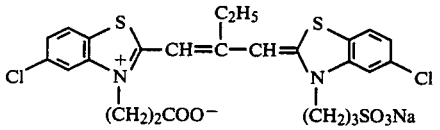
(14)
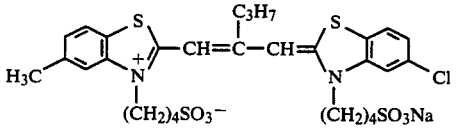
(15)
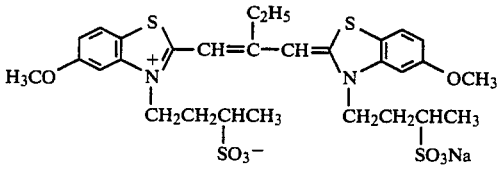
(16)
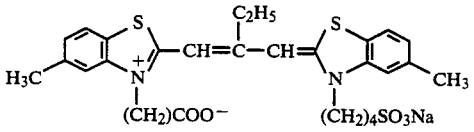
(17)
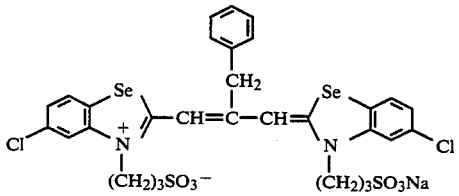
IIe
(18)
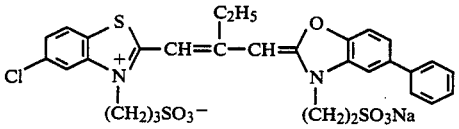
(19)
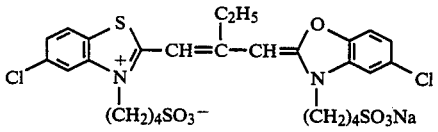
(20)
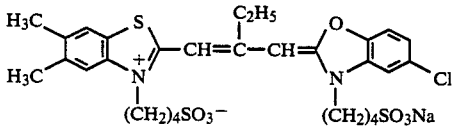
(21)
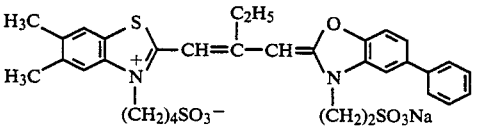
-continued
(22)
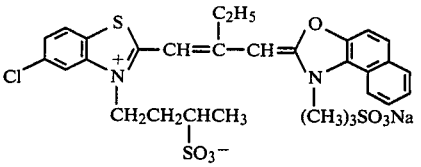
IIf
(23)
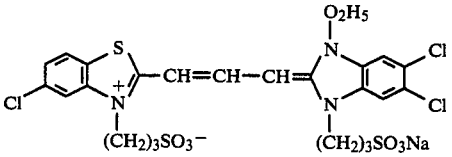
(24)
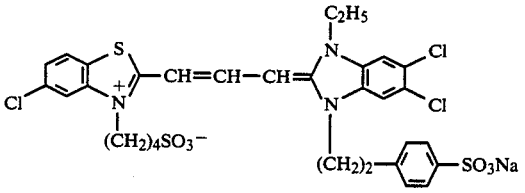
(25)
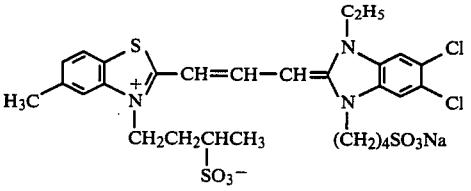
(26)
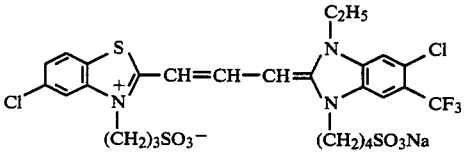
IIg
(27)
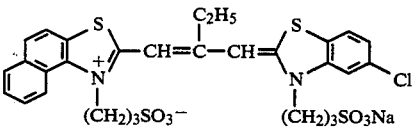
(28)
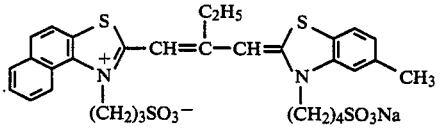
(29)
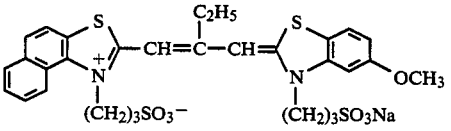
(30)
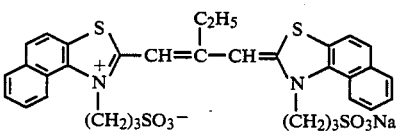

-continued (31)

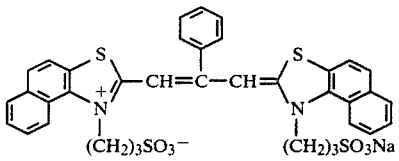

(32)

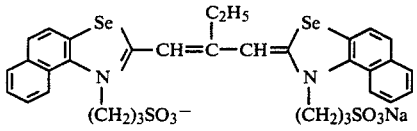

IIh (33)

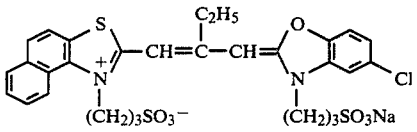

(34)

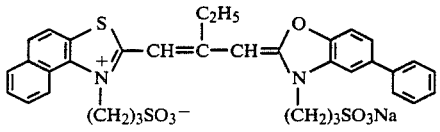

(35)

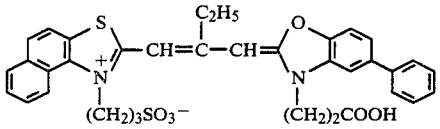

(36)

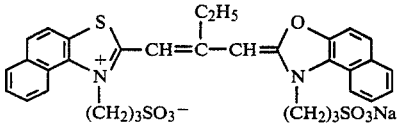

Ii (37)

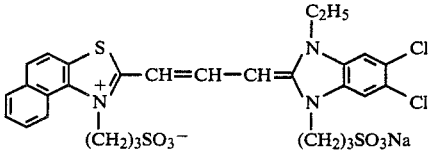

(38)

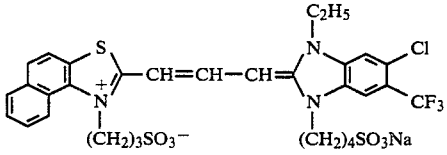

(39)

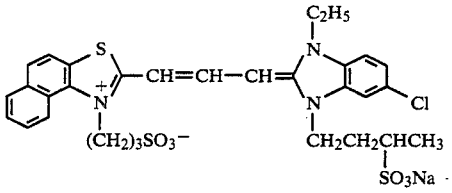

The sensitizing dyes shown by general formulae (I) and (II) described above are known compounds and may be easily prepared with reference to F. M. Hamer, *Cyanine Dyes and Related Compounds,* John Wiley & Sons, New York, 1964 and D. M. Sturmer, *The Chemistry of Heterocyclic Compounds,* Vol. 30, John Wiley & Sons, New York, 1977, p. 441.

The emulsions may contain dyes which do not have a spectral sensitization function themselves or substances which do not substantially absorb visible light but which cause supersensitization together with the above described sensitizing dyes. For example, the emulsions may contain aminostilbene compounds substituted by nitrogen containing heterocyclic groups (for example, those described in U.S. Pat. Nos. 2,933,390 and 3,635,721), condensation products of aromatic acids and formaldehyde (for example, those described in U.S. Pat. No. 3,743,510), cadmium salts and azaindene compounds, etc. The combinations of materials described in U.S. Pat. Nos. 3,615,613, 3,615,641, 3,617,295 and 3,635,721 are particularly useful.

The sensitizing dyes of the present invention are used in the same amounts as are used for conventional negative type silver halide emulsions. It is preferred to use each sensitizing dye in an amount of about $1.0\times10^{-5}$ to about $1.0\times10^{-3}$ mol per mol of silver halide, more preferably about $4\times10^{-5}$ to $5\times10^{-4}$ mol per mol of silver halide.

The optimum amount of the sensitizing dyes can be determined by a known method which comprises dividing an emulsion into equal parts to which a sensitizing dye is added in differing amounts, respectively, and then measuring spectral sensitivity thereof.

The molar ratio of the sensitizing dyes represented by general formula (I) to the sensitizing dyes represented by general formula (II) used in the present invention can be suitably selected from the range of the sensitizing dyes represented by general formula (I)/the sensitizing dyes represented by general formula (II)=1/20 to 20/1, more preferably in the range of 1/20 to 1/1.

With respect to the order of addition of the sensitizing dyes used in the present invention, the sensitizing dyes represented by general formula (II) are first added to the silver halide emulsion and thereafter the sensitizing dyes represented by general formula (I) are added thereto. In this case, the time from the addition of the sensitizing dyes represented by general formula (II) to the addition of the sensitizing dyes represented by general formula (I) is not especially limited, if the sensitizing dyes represented by general formula (II) are added with sufficient stirring, but it is preferred that the sensitizing dyes represented by general formula (I) be added after the passage of 1 minute or more, preferably 5 minutes or more, from the addition of the sensitizing dyes represented by general formula (II). The allowable maximum time intervals from the addition of the sensitizing dyes of general formula (II) to that of the sensitizing dyes of general formula (I) is approximately 120 minutes.

When the sensitizing dyes are added in the above order of addition, the fact that a layer of the dyes represented by general formula (I) is adsorbed on a layer of the dyes represented by general formula (II) can be determined by measuring the zeta potential as described in *Photogr. Sci. Eng.,* 20(3), 97 (1976) and *The Theory of the Photographic Process,* 4th Edition (Macmillan Co., 1977), chapter 9, paragraph E, page 241. Namely, when anionic dyes such as dyes represented by general formula (II) are adsorbed on silver halide particles in a negatively charged state, the zeta potential hardly changes, but it turns to a positive value upon increasing the amount of cationic dye(s) such as dyes represented by general formula (I) when they are added.

Sensitizing dyes which are not included in general formulae (I) and (II) can be additionally added to the emulsions of the present invention.

The addition of all such sensitizing dyes is carried out by conventional methods well known in this field.

These sensitizing dyes can be directly dispersed in the emulsion. Alternatively, the can be first dissolved in a water-miscible solvent such as pyridine, methyl alcohol, ethyl alcohol, methyl cellosolve, acetone, etc. (or a mixture of the above solvents) and, in certain cases, diluted with water, or they can be dissolved in only water, and the resultant solution can be added to the emulsion. Further, ultrasonic vibration can be used for dissolution. In addition, the methods described in, for example, Japanese Patent Publication Nos. 8231/70, 23389/69, 27555/69 and 22948/69, German Patent Application (OLS) Nos. 1,947,935 and U.S. Pat. Nos. 3,485,634, 3,342,605 and 2,912,343, etc., may be used.

The silver halide emulsions used in the present invention are hydrophilic colloidal dispersions of silver bromide, silver chloride, silver chlorobromide, silver iodobromide, silver chloroiodobromide or a mixture thereof. Though the halogen composition is selected according to the purpose of using the sensitive material and the processing conditions, it is particularly preferred to use silver bromide, silver iodobromide or silver chloroiodobromide which have a chloride content of 30 mol% or less and an iodide content of 10 mol% or less.

The silver halide particles used in the present invention may be fine particles and/or coarse particles, but it is preferred that the average particle size be in the range of 0.2 micron to 2 microns.

The inner latent image type emulsion used in the present invention is preferably a silver halide emulsion in which latent images are formed in the inner part of silver halide particles, which is distinguished from silver halide particles in which latent images are mainly formed on the surface of the particles. Such inner latent image type emulsions are described in U.S. Pat. No. 2,592,250, Davey et al. The inner latent image type silver halide emulsion can also be defined as one wherein the maximum density obtained in the case of developing with an "inner type" developing solution is greater than the maximum density obtained in the case of developing with a "surface type" developing solution. The inner latent image type emulsions suitable for the present invention are those where the maximum density (measured by a conventional method of measuring photographic density) when the silver halide emulsion is applied to a transparent base, exposed to light for a fixed time of 0.01 to 1 second and developed with the following developing solution (A) (inner type developing solution) at 20° C. for 3 minutes is at least 5 times greater than the maximum density obtained in the case of developing the silver halide emulsion exposed to light in the same manner as described above with the following developing solution B (surface type developing solution) at 20° C. for 4 minutes. It is preferred that the maximum density obtained with developing solution A be more than 10 times of the maximum density obtained with developing solution B.

| Developing Solution A | |
|---|---|
| Hydroquinone | 15 g |
| Monomethyl-p-aminophenol sesquisulfate | 15 g |
| Sodium sulfite | 50 g |
| Potassium bromide | 10 g |
| Sodium hydroxide | 25 g |
| Sodium thiosulfate | 20 g |
| Water to make | 1 l |

-continued

| Developing Solution B | |
|---|---|
| p-Oxyphenylglycine | 10 g |
| Sodium carbonate | 100 g |
| Water to make | 1 l |

As inner latent image type emulsions suitable for use in the present invention, there are, for example, conversion emulsions prepared by a catastrophic precipitation process which comprises first producing silver salt particles having high solubility, such as silver chloride, and converting the same into a silver salt having low solubility, such as silver (iodo)bromide (U.S. Pat. No. 2,592,250), core-shell emulsions prepared by a process which comprises mixing a chemically sensitized core emulsion of large particles with an emulsion of fine particles, and aging to cover the core particles with a shell of silver halide (U.S. Pat. No. 3,206,313 and British Pat. No. 1,011,062), core-shell emulsions prepared by a process which comprises adding a solution of soluble silver salts and a solution of soluble halides at the same time to a chemically sensitized monodispersion core emulsion while keeping the silver ion concentration at a constant value to cover the core particles with a shell of silver halide (British Pat. No. 1,027,146 and U.S. Pat. No. 3,761,276), halogen localization emulsions in which emulsion particles have a laminated construction of two or more layers each of which has a different halogen composition (U.S. Pat. No. 3,935,014), and emulsions containing different metals prepared by forming silver halide particles in an acid medium containing trivalent metal ions (U.S. Pat. No. 3,447,927), etc. In addition, one can use emulsions prepared by processes as described in *Photographic Emulsions,* pages 35 to 36 and 52 to 53 written by E. J. Wall, American Photographic Publishing Co. (1929), U.S. Pat. Nos. 2,497,875, 2,563,785 and 3,511,662 and German Patent Application (OLS) No. 2,728,108, etc.

As typical examples of nucleus forming agents used in the present invention, there are hydrazines as described in U.S. Pat. Nos. 2,588,982 and 2,563,785, hydrazides and hydrazones as described in U.S. Pat. No. 3,227,552, quaternary salt compounds as described in British Pat. No. 1,283,835, Japanese Patent Publication No. 38164/74 and U.S. Pat. Nos. 3,734,738, 3,719,494 and 3,615,615, sensitizing dyes having a nucleating substituent in the dye molecule as described in U.S. Pat. No. 3,718,470, and acylhydrazinophenyl-thiourea compounds as described in U.S. Pat. Nos. 4,030,925 and 4,031,127.

The nucleus forming agents used in the present invention act during development processing or during prebath processing to preferentially form surface development nuclei on silver halide particles which have no inner latent image (inner development nucleus), whereby the silver halide particles can be developed with a surface developing solution, and it is believed that the nucleus forming agents are preferred to essentially have no function of forming surface development nuclei on silver halide particles which already have inner latent images (inner development nuclei).

The amount of the nucleus forming agent used can be varied over a wide range according to the desired result. In the case that the nucleus forming agent is added to a light-sensitive material, it is generally used in an amount of 50 to 15,000 mg/mol of Ag, preferably 300 to 6,000 mg/mol of Ag.

In the case that the nucleus forming agent is added to a developing solution, the amount thereof is preferably in the range of about 0.05 to 5 g (more preferably 0.1 to 1 g) per liter of developing solution.

In the case that the nucleus forming agent is added to any layer of the light-sensitive material, it is most effective that the nucleus forming agent be non-diffusible.

Further, instead of carrying out development processing in the presence of the nucleus forming agent, the emulsion of the present invention which has not been previously fogged may be fogged during development processing by exposure to light.

The inner latent image type silver halide photographic emulsions of the present invention can be used for various uses, and, particularly, they can be advantageously used as emulsions for direct positive type photographic light-sensitive materials, emulsions for reversal color light-sensitive materials having a multilayer construction and emulsions for color diffusion transfer light-sensitive materials having a multilayer construction. As dye image providing compounds combined for producing color photographic light-sensitive materials, various compounds can be utilized, but couplers and dye releasing redox compounds are particularly useful.

In the case of using dye forming couplers, they may be present in the silver halide light-sensitive material. Alternatively, they may be present in the processing solution. In order to add the dye forming couplers to the silver halide emulsions of the present invention, known conventional methods can be used. For example, it is possible to use methods as described in U.S. Pat. Nos. 1,055,155, 1,102,028, 2,186,849, 2,322,027 and 2,801,171.

The photographic emulsions of the present invention can be combined with diffusion transfer dye providing substances which release a diffusible dye corresponding to development of silver halide, so that desired transfer images are obtained on an image receiving layer after carrying out a suitable development processing.

Particularly useful diffusible dye providing substances are dye releasing redox compounds which release a dye by alkali hydrolysis when they are subjected to oxidation. Examples thereof include those described in the following literature.

U.S. Pat. Nos. 4,053,312, 4,055,428, 4,076,529, 4,152,153, 4,135,929 and 4,336,332, and Japanese Patent Application (OPI) Nos. 104343/76, 46730/78, 130122/79, 3819/78, 12642/81, 16130/81 and 16131/81, etc.

Substances which release a yellow dye: U.S. Pat. No. 4,013,633, Japanese Patent Application (OPI) Nos. 149328/78, 114930/76 and 71072/76, and *Research Disclosure* 17630 (1978) and 16475 (1977), etc.

Substances which release a magenta dye: U.S. Pat. Nos. 3,954,476, 3,931,144 and 3,932,308 and Japanese Patent Application (OPI) Nos. 23628/78, 106727/77, 65034/79, 161332/79, 4028/80, 36804/80, 73057/81, 71060/81, 134602/80 and 65034/79, etc.

Substances which release a cyan dye: U.S. Pat. Nos. 3,942,987, 3,929,760 and 4,013,635 and Japanese Patent Applications (OPI) Nos. 109928/76, 149328/78, 8827/77, 143323/78, 47823/78 and 71061/81, etc.

As redox compounds which release a dye by ring-closure, etc., of the compounds which are not subjected to oxidation, there are the materials described in the following literature.

U.S. Pat. Nos. 4,139,379 and 3,980,479, and German Patent Application (OLS) Nos. 2,402,900 and 2,448,811, etc.

Further, couplers useful in the present invention are described in, for example, *The Theory of Photographic Process* (4th Edition, 1977, edited by T. H. James), chapter 12. In the following, the case of using a redox compound is illustrated as a typical example, but the disclosure applies with equal force to the case of using other dye image providing substances.

The coated amount of the dye releasing redox compound used is preferably in the range of $1\times10^{-4}$ to $1\times10^{-2}$ mol/m$^2$, preferably $2\times10^{-4}$ to $2\times10^{-3}$ mol/m$^2$.

The dye releasing redox compounds used in the present invention can be dispersed in a hydrophilic colloid as a carrier by various methods according to the type of compound. For example, compounds having a dissociative group such as a sulfo group or a carboxyl group can be dispersed by adding a solution of them prepared by dissolving them in water or an aqueous alkali solution to a hydrophilic colloid solution. On the other hand, compounds which are difficult to dissolve in aqueous media but are easily soluble in organic solvents can be dispersed by the following methods.

(1) Dispersing the compounds by adding a solution of them prepared by dissolving them in a substantially water-insoluble high boiling point solvent to a hydrophilic colloid solution. This method has been described in, for example, U.S. Pat. Nos. 2,322,027, 2,533,514 and 2,801,171. Further, if necessary, low boiling point solvents or water-soluble organic solvents may be used, which can be removed by drying to evaporate or by washing with water.

(2) Dissolving the compounds in a water-miscible solvent and then dispersing in a hydrophilic colloid solution.

(3) Using an oleophilic polymer instead of or together with the high boiling point solvent in the above described method (1). This method has been described in, for example, U.S. Pat. No. 3,619,195 and German Pat. No. 1,957,467.

(4) Dissolving the compounds in a water-miscible solvent and then slowly adding an aqueous latex to the resultant solution to obtain a dispersion in which the compounds are contained in the latex particles. This method has been described in, for example, Japanese Patent Application (OPI) No. 59943/76.

In addition, to the hydrophilic colloid dispersion obtained in the above, a hydrosol of an oleophilic polymer described in, for example, Japanese Patent Publication No. 39835/76 may be added.

The dispersion of the dye releasing redox compounds is remarkably promoted by using surface active agents as emulsification assistants. Effective surface active agents have been described in, for example, Japanese Patent Publication No. 4923/64 and U.S. Pat. No. 3,676,141.

Examples of hydrophilic colloids used for dispersing the dye releasing redox compounds used in the present invention include gelatin, colloidal albumin, casein, cellulose derivatives such as carboxymethyl cellulose or hydroxyethyl cellulose, etc., saccharose derivatives such as agar, sodium alginate or starch derivatives, etc., and synthetic hydrophilic colloids, for example, polyvinyl alcohol, poly-N-vinylpyrrolidone, acrylic acid copolymers, polyacrylamide or derivatives thereof (for example, partially hydrolyzed products), etc. If desired or necessary, a compatible mixture of two or more of these colloids can be used. Among them, gelatin is most generally used, but a part or the whole of the gelatin may be substituted by synthetic hydrophilic colloids.

Processes for obtaining color diffusion transfer images using dye releasing redox compounds have been described in *Photographic Science and Engineering,* Vol. 20, No. 4, pp. 155–164, July/August, 1976.

In the above described processes, any silver halide developing agent can be used if it is capable of causing cross-oxidation of the dye releasing redox compounds. The developing agent may be contained in an alkaline processing composition or may be contained in a suitable layer of the photographic element. Examples of developing agents capable of use in the present invention are as follows.

Hydroquinones, aminophenols, phenylenediamines and pyrazolidinones (for example, phenidone, 1-phenyl-3-pyrazolidinone, dimethone (1-phenyl-4,4-dimethyl-3-pyrazolidinone), 1-p-tolyl-4-methyl-4-oxymethyl-3-pyrazolidinone, 1-(4'-methoxyphenyl)-4-methyl-4-oxymethyl-3-pyrazolidinone and 1-phenyl-4-methyl-4-oxymethyl-3-pyrazolidinone), etc., as described in Japanese Patent Application (OPI) No. 16131/81.

Among the above described substances, black-and-white developing agents having the capability of reducing the formation of stains in the image receiving layer (particularly, pyrazolidinones) are generally particularly preferred to color developing agents such as phenylenediamines, etc.

The processing compositions used for processing the photographic light-sensitive materials of the present invention contain bases such as sodium hydroxide, potassium hydroxide, sodium carbonate or sodium phosphate and have an alkalinity of pH 9 or more, preferably 11.5 or more. The processing compositions may contain antioxidants such as sodium sulfite, ascorbic acid salts or piperidinohexose reductone or may contain silver ion concentration controllers such as potassium bromide. Further, they may contain viscosity increasing agents such as hydroxyethyl cellulose or sodium carboxymethyl cellulose.

Furthermore, the alkaline processing compositions may contain compounds which accelerate development or accelerate the diffusion of dyes (for example, benzyl alcohol).

In order to effect reproduction of natural colors by a subtractive process, light-sensitive materials having at least two combinations consisting of an emulsion which has a selective spectral sensitivity in a certain wavelength range and a compound which gives a dye image having a selective spectral absorption in the same wavelength range are used.

Light-sensitive elements composed of a combination of a blue-sensitive silver halide emulsion and a yellow dye releasing redox compound, a combination of a green-sensitive emulsion and a magenta dye releasing redox compound and a combination of a red-sensitive emulsion and a cyan dye releasing redox compound are particularly suitable for use. These combination units of the emulsion and the dye releasing redox compound may be applied in layers so as to have a face-to-face relationship in the light-sensitive material or may be applied as a single layer of a mixture thereof by forming particles (the dye releasing redox compound and the silver halide particles are present in the same particle).

A segregation layer may be provided between an intermediate layer and a layer containing the dye image providing substance as described in Japanese Patent Application (OPI) No. 52056/80. Further, a silver halide emulsion may be added to the intermediate layer as described in Japanese Patent Application (OPI) No. 67850/81.

As a mordant layer, neutralization layer, neutralization rate controlling layer (timing layer) and as the processing compositions, etc., capable of use in the color diffusion transfer light-sensitive materials of the present invention, those described in Japanese Patent Application (OPI) No. 64533/77 can be utilized.

In the case of using the light-sensitive materials of the present invention in a color diffusion transfer process, it is possible to use a separation (peel apart) type film unit as described in U.S. Pat. No. 2,983,606, a unitary (integrated) type film unit as described in Japanese Patent Publication No. 16356/71 (U.S. Pat. Nos. 3,415,645 and 3,415,646), Japanese Patent Publication No. 33697/73 (U.S. Pat. No. 3,594,164), Japanese Patent Application (OPI) No. 13040/75 (U.S. Pat. No. 3,993,486) and British Pat. No. 1,330,524 or a non-separation type light-sensitive material as described in Japanese Patent Application (OPI) No. 11934/82 (European Pat. No. 53328).

In any of the above described formats, it is advantageous from the viewpoint of expanding the range of the processing temperature to use a polymer acid layer protected by a temporary barrier layer whereby the neutralization timing time is shortened at high processing temperatures, such as a fusion latex polymer layer as described in Japanese Patent Applications (OPI) Nos. 145217/77 (U.S. Pat. No. 4,056,394), 72622/78 (U.S. Pat. No. 4,199,362), 78130/79 (U.S. Pat. No. 4,250,243), 138432/79 (U.S. Pat. No. 4,256,827) and 138433/79 (U.S. Pat. No. 4,268,604), etc., or a lactone ring containing polymer as described in Japanese Patent Application (OPI) No. 54341/80 (U.S. Pat. No. 4,229,516) and *Research Disclosure,* 18425 (1979), etc.

The photographic compositions described in this patent specification can be applied to various kinds of bases to produce photographic elements. Photographic silver halide emulsions can be applied to one or both sides of the base, preferably a transparent and/or flexible base. Examples of typical bases include cellulose nitrate films, cellulose acetate films, polyvinyl acetal films, polystyrene films, polyethylene terephthalate films and other polyester films, glass, paper, metal and wood, etc. Bases such as paper coated with an $\alpha$-olefin polymer, particularly a polymer of an $\alpha$-olefin having 2 or more carbon atoms, for example, polyethylene, polypropylene or an ethylene-butene copolymer, etc., produce good results.

Photographic silver halide emulsion layers and other suitable layers in the photographic elements produced according to the present invention can be hardened with suitable hardening agents. Examples of these hardening agents include aldehyde hardening agents such as formaldehyde or mucochloric acid, aziridine hardending agents, dioxane derivatives and oxypolysaccharides such as oxystarch, etc.

As hardeners, those described in *Product Licensing Index,* Vol. 92, p. 108, "Hardeners", can be used.

To the photographic silver halide emulsion layers, it is possible to add other additives, particularly, those which are known to be useful for photographic emulsions, for example, lubricants, speed increasing agents, light absorbing dyes and plasticizers, etc.

The silver halide emulsions may contain coating aids. As coating aids, those described in *Product Licensing Index,* Vol. 92, p. 108, "Coating Aids", can be used.

Further, the silver halide emulsions in the present invention may contain compounds which release iodine ions (for example, potassium iodide, etc.). Moreover, it is possible to obtain desired images using a developing solution containing iodine ions.

In the preparation of the photographic materials of the present invention, it is frequently advantageous to use a surface active agent or a mixture thereof. Suitable surface active agents include nonionic, ionic and ampholytic surface active agents, for example, polyoxyalkylene derivatives and amphoteric amino acid dispersing agents (including sulfobetaines), etc. Examples thereof are described in U.S. Pat. Nos. 2,600,831, 2,271,622, 2,271,623, 2,275,727, 2,787,604, 2,816,920 and 2,739,891 and Belgian Pat. No. 652,862.

For the purpose of increasing contrast or accelerating development, the photographic emulsions of the present invention may contain, for example, polyalkylene oxides or derivatives thereof such as ether, ester or amine derivatives, etc., thioether compounds, thiomorpholines, quaternary ammonium salt compounds, urethane derivatives, urea derivatives, imidazole derivatives and 3-pyrazolidones, etc. For example, it is possible to use those described in U.S. Pat. Nos. 2,400,532, 2,423,549, 2,716,062, 3,617,280, 3,772,021 and 3,808,003, etc.

The silver halide emulsions of the present invention may contain antifoggants and stabilizers. It is possible to use compounds as described in *Product Lisencing Index,* Vol. 92, p. 107, "Antifoggants and Stabilizers".

Preferred embodiments of the present invention are as follows.

(1) Photographic light-sensitive materials capable of providing direct positive images by surface development in the presence of a nucleus forming agent after imagewise exposure to light which have at least one inner latent image type silver halide emulsion layer.

(2) Inner latent image type silver halide photographic light-sensitive materials wherein W and Y in general formulae (I) and (II) are identical to each other.

(3) Photographic light-sensitive materials according to Embodiment (2), wherein the sensitizing dye represented by general formula (I) is selected from formulae (I*a*), (I*c*); (I*d*) and (I*g*), and the sensitizing dye represented by general formula (II) is selected from formulae (II*a*), (II*c*), (II*d*) and (II*g*).

(4) Diffusion transfer light-sensitive materials according to Embodiment (1), which comprises a sensitive material unit combined with non-diffusible dye image providing substances which release diffusible dyes corresponding to the developed silver amount in the emulsion layers, a mordant unit which receives the diffusible dyes and a treating solution unit for processing the sensitive material unit.

(5) Diffusion transfer color light-sensitive materials according to Embodiment (4), wherein the emulsion layers are composed of a red-sensitive emulsion layer, a green-sensitive emulsion layer and a blue-sensitive emulsion layer.

(6) Diffusion transfer light-sensitive materials according to Embodiment (4), wherein the mordant layer which receives the diffusible dyes is contained in the sensitive material unit.

Having thus generally described the invention, the following Examples are offered to illustrate the same.

EXAMPLE 1

An inner latent image type emulsion was prepared by the following procedure. Equimolar amounts of an aqueous solution of silver nitrate and an aqueous solution of potassium bromide were added to 1 l of an aqueous solution containing 10 g of gelatin at 50° C. over 30 minutes by a controlled double jet process to obtain octahedral silver bromide particles having a size of 0.35μ. To the resultant core emulsion, 1.0 mg of sodium thiosulfate/1 mol silver and 1.7 mg of potassium chloroaurate (III)/1 mol silver were added, and chemical aging was carried out at 60° C. for 45 minutes. Furthermore, equimolar amounts of the aqueous solution of silver nitrate and the aqueous solution of potassium bromide were added to the chemically aged core emulsion at 60° C. over 40 minutes by a controlled double jet process to produce a core/shell type direct reversal photographic emulsion having a size of 1.00μ. After formation of the shell, 0.5 mg of sodium thiosulfate/1 mol silver and 0.75 mg of potassium chloroaurate (III)/1 mol silver were added to carry out chemical sensitization of the surface of the shell.

To 1 kg of the emulsion prepared as described above, a dye represented by general formula (II) was added with stirring and, after 8 minutes, a dye represented by general formula (I) was added, as shown in Tables 1 to 6 (in the case of comparison, the order of addition of the dyes were reversed).

The silver halide emulsions were applied to triacetyl cellulose bases so as to result in a silver content of 330 $\mu g/cm^2$, and dried to produce test samples. After the samples were imagewise exposed to light, they were developed at 20° C. for 5 minutes with the following developing solution, and their properties were compared. The results are shown in Table 1 to Table 6.

In Table 1 to Table 6, the reversal sensitivity is the reciprocal value of exposure which produces a density corresponding to (minimum transmission density +0.5), which is represented by a relative value to the control sample (shown as standard in the Tables).

| Developing Solution: | |
|---|---|
| Water | 500 ml |
| N—Methyl-p-aminophenol sesquisulfate | 2.0 g |
| Sodium sulfite | 90.0 g |
| Hydroquinone | 8.0 g |
| Sodium carbonate | 52.5 g |
| Sodium bromide | 5.0 g |
| Potassium iodide | 0.3 g |
| Water to make | 1.0 l |

TABLE 1

| No. | Dye No. of Previous Addition | Amount (mol/mol AgX) | Dye No. of Subsequent Addition | Amount (mol/mol AgX) | Reversal Sensitivity | Maximum Density | Minimum Density |
|---|---|---|---|---|---|---|---|
| 1 (comparison) | (IIa-3) | $3.52 \times 10^{-4}$ | — | — | 100 (standard) | 1.71 | 0.15 |
| 2 (comparison) | — | — | (Ia-1) | $1.10 \times 10^{-4}$ | 56 | 1.42 | 0.14 |

TABLE 1-continued

| No. | Dye No. of Previous Addition | Amount (mol/mol AgX) | Dye No. of Subsequent Addition | Amount (mol/mol AgX) | Reversal Sensitivity | Maximum Density | Minimum Density |
|---|---|---|---|---|---|---|---|
| 3 (the present invention) | (IIa-3) | $2.42 \times 10^{-4}$ | (Ia-1) | $1.10 \times 10^{-4}$ | 129 | 1.72 | 0.14 |
| 4 (comparison) | (Ia-1) | $1.10 \times 10^{-4}$ | (IIa-3) | $2.42 \times 10^{-4}$ | 78 | 1.60 | 0.15 |

TABLE 2

| No. | Dye No. of Previous Addition | Amount (mol/mol AgX) | Dye No. of Subsequent Addition | Amount (mol/mol AgX) | Reversal Sensitivity | Maximum Density | Minimum Density |
|---|---|---|---|---|---|---|---|
| 1 (comparison) | (IId-13) | $3.61 \times 10^{-4}$ | — | — | 100 (standard) | 1.68 | 0.15 |
| 2 (comparison) | — | — | (Id-9) | $0.92 \times 10^{-4}$ | 60 | 1.12 | 0.14 |
| 3 (the present invention) | (IId-13) | $2.69 \times 10^{-4}$ | (Id-9) | $0.92 \times 10^{-4}$ | 132 | 1.70 | 0.15 |
| 4 (comparison) | (Id-9) | $0.92 \times 10^{-4}$ | (IId-13) | $2.69 \times 10^{-4}$ | 81 | 1.47 | 0.15 |

TABLE 3

| No. | Dye No. of Previous Addition | Amount (mol/mol AgX) | Dye No. of Subsequent Addition | Amount (mol/mol AgX) | Reversal Sensitivity | Maximum Density | Minimum Density |
|---|---|---|---|---|---|---|---|
| 1 (comparison) | (IIf-23) | $3.30 \times 10^{-4}$ | — | — | 100 (standard) | 1.63 | 0.16 |
| 2 (comparison) | — | — | (If-16) | $1.33 \times 10^{-4}$ | 66 | 0.71 | 0.16 |
| 3 (the present invention) | (IIf-23) | $1.97 \times 10^{-4}$ | (If-16) | $1.33 \times 10^{-4}$ | 117 | 1.63 | 0.16 |
| 4 (comparison) | (If-16) | $1.33 \times 10^{-4}$ | (II-f-23) | $1.97 \times 10^{-4}$ | 85 | 1.19 | 0.17 |

TABLE 4

| No. | Dye No. of Previous Addition | Amount (mol/mol AgX) | Dye No. of Subsequent Addition | Amount (mol/mol AgX) | Reversal Sensitivity | Maximum Density | Minimum Density |
|---|---|---|---|---|---|---|---|
| 1 (comparison) | (IIg-27) | $3.19 \times 10^{-4}$ | — | — | 91 | 1.70 | 0.15 |
| 2 (comparison) | (IIg-31) | $3.19 \times 10^{-4}$ | — | — | 100 (standard) | 1.68 | 0.15 |
| 3 (comparison) | — | — | (Ig-22) | $0.90 \times 10^{-4}$ | 68 | 0.82 | 0.14 |
| 4 (the present invention) | (IIg-27) | $2.29 \times 10^{-4}$ | (Ig-22) | $0.90 \times 10^{-4}$ | 120 | 1.71 | 0.14 |
| 5 (the present invention) | (IIg-31) | $2.29 \times 10^{-4}$ | (Ig-22) | $0.90 \times 10^{-4}$ | 132 | 1.70 | 0.14 |
| 6 (comparison) | (Ig-22) | $0.90 \times 10^{-4}$ | (IIg-27) | $2.29 \times 10^{-4}$ | 87 | 1.34 | 0.15 |
| 7 (comparison) | (Ig-22) | $0.90 \times 10^{-4}$ | (IIg-31) | $2.29 \times 10^{-4}$ | 89 | 1.33 | 0.15 |

TABLE 5

| No. | Dye No. of Previous Addition | Amount (mol/mol AgX) | Dye No. of Subsequent Addition | Amount (mol/mol AgX) | Reversal Sensitivity | Maximum Density | Minimum Density |
|---|---|---|---|---|---|---|---|
| 1 (comparison) | (IIh-34) | $3.40 \times 10^{-4}$ | — | — | 100 (standard) | 1.73 | 0.15 |
| 2 (comparison) | — | — | (Ih-25) | $1.10 \times 10^{-4}$ | 55 | 1.20 | 0.14 |
| 3 (the present invention) | (IIh-34) | $2.30 \times 10^{-4}$ | (Ih-25) | $1.10 \times 10^{-4}$ | 138 | 1.72 | 0.13 |
| 4 | (Ih-25) | $1.10 \times 10^{-4}$ | (IIh-34) | $2.30 \times 10^{-4}$ | 72 | 1.43 | 0.15 |

TABLE 5-continued

| No. | Dye No. of Previous Addition | Amount (mol/mol AgX) | Dye No. of Subsequent Addition | Amount (mol/mol AgX) | Reversal Sensitivity | Maximum Density | Minimum Density |
|---|---|---|---|---|---|---|---|
| (comparison) | | | | | | | |

TABLE 6

| No. | Dye No. of Previous Addition | Amount (mol/mol AgX) | Dye No. of Subsequent Addition | Amount (mol/mol AgX) | Reversal Sensitivity | Maximum Density | Minimum Density |
|---|---|---|---|---|---|---|---|
| 1 (comparison) | (IIi-37) | $3.40 \times 10^{-4}$ | — | — | 100 (standard) | 1.64 | 0.16 |
| 2 (comparison) | — | — | (Ii-28) | $1.20 \times 10^{-4}$ | 49 | 0.84 | 0.14 |
| 3 (the present invention) | (IIi-37) | $2.20 \times 10^{-4}$ | (Ii-28) | $1.20 \times 10^{-4}$ | 126 | 1.65 | 0.15 |
| 4 (comparison) | (Ii-28) | $1.20 \times 10^{-4}$ | (IIi-37) | $2.20 \times 10^{-4}$ | 79 | 1.22 | 0.16 |

As can be seen from Table 1 to Table 6, a remarkably higher maximum density, a lower minimum density and/or a remarkably higher reversal sensitivity were achieved using the sensitizing dyes of general formulae (I) and (II) and by adding previously the dyes of general formula (II) and subsequently the dyes of general formula (I) as compared to the case of using the sensitizing dyes of general formula (I) only or the dyes of general formula (II) only, and to the case of using the sensitizing dyes of general formulae (I) and (II) with the reversed order of the addition.

EXAMPLE 2

An emulsion was prepared in the same manner as in Example 1.

Then, a light-sensitive sheet, a cover sheet and a treating solution used for color diffusion transfer light-sensitive materials were produced as follows.

To a polyethylene terephthalate transparent base, the following (1) to (6) were applied in turn to produce the light-sensitive sheet.

Light-Sensitive Sheet (1) An image receiving layer containing 3.0 g/m$^2$ of an aqueous polymer latex of the following Compound A, 3.0 g/m$^2$ of gelatin and 0.3 g/m$^2$ of a coating aid (the following Compound B).

(2) A white reflection layer containing 17.6 g/m$^2$ of titanium dioxide and 2.5 g/m$^2$ of gelatin.

(3) A light-shielding layer containing 2.0 g/m$^2$ of carbon black and 1.5 g/m$^2$ of gelatin.

(4) A layer containing 0.50 g/m$^2$ of a magenta dye releasing redox compound (the following Compound C), 0.10 g/m$^2$ of tricyclohexyl phosphate, 0.008 g/m$^2$ of 2,5-di-t-pentadecylhydroquinone and 0.58 g/m$^2$ of gelatin.

(5) A green-sensitive inner latent image type direct positive silver bromide emulsion layer having a silver content of 0.85 g/m$^2$ containing 0.95 g/m$^2$ of gelatin, 0.05 mg/m$^2$ of a nucleus forming agent (Compound D) and 0.13 g/m$^2$ of 2-sulfo-5-pentadecylhydroquinone sodium salt, which was spectrally sensitized by adding a sensitizing dye represented by general formula (II) and thereafter adding a sensitizing dye represented by general formula after the passage of 8 minutes (in the case of comparison, the order of adding the dyes was reversed) as shown in Table 7 to Table 10.

(6) A layer containing 1.0 g/m$^2$ of gelatin.

The cover sheet was produced as follows.

Cover Sheet

To a transparent polyethylene terephthalate base, the following layers (1') to (3') were applied in turn to produce the cover sheet.

(1') A layer containing an 80:20 (ratio by weight) copolymer of acrylic acid and butyl acrylate (22 g/m$^2$) and 1,4-bis(2,3-epoxypropoxy)butane (0.44 g/m$^2$).

(2') A layer containing acetyl cellulose (which was prepared by hydrolyzing 100 g of acetyl cellulose so as to form 39.4 g of acetyl groups) (3.8 g/m$^2$), a 60:40 (ratio by weight) copolymer of styrene and maleic acid anhydride (molecular weight: about 50,000) which was ring-opened by methanol (0.23 g/m$^2$) and 5-(2-cyano-1-methylethylthio)-1-phenyltetrazole (0.154 g/m$^2$).

(3') A layer having a thickness of 2$\mu$, which was prepared by blending a 49.7:42.3:3:5 copolymer latex of styrene-n-butyl acrylate-acrylic acid-N-methylolacrylamide and a 93:4:3 (ratio by weight) copolymer latex of methyl methacrylate-acrylic acid-N-methylolacrylamide so as to have a solids content ratio of the former to the latter of 6:4.

After the above described light-sensitive sheet was imagewise exposed to light through a yellow filter, the above described cover sheet was put thereon, and the following treating solution was spread between both sheets to a thickness of 85$\mu$ (spreading was carried out by the aid of a press roll) and development was carried out at 25° C.

The results of sensitometry measurements on the resultant reversal yellow images are shown in Table 7 to Table 10. The sensitivity of the reversal image is the reciprocal value of exposure which produced a density corresponding to (maximum image density −0.3), which is represented by a relative value to the control sample (shown as standard in the tables).

| Treating Solution: | |
|---|---|
| 1-p-Tolyl-4-hydroxymethyl-4-methyl-3-pyrazolidone | 6.9 g |
| Methylhydroquinone | 0.3 g |
| 5-Methylbenzotriazole | 3.5 g |
| Sodium sulfite (anhydrous) | 0.2 g |
| Carboxymethyl cellulose Na salt | 58 g |
| Potassium hydroxide (28% aq. soln.) | 200 cc |
| Benzyl alcohol | 1.5 cc |
| Carbon black | 150 g |
| Water | 685 cc |

-continued

Compound A:

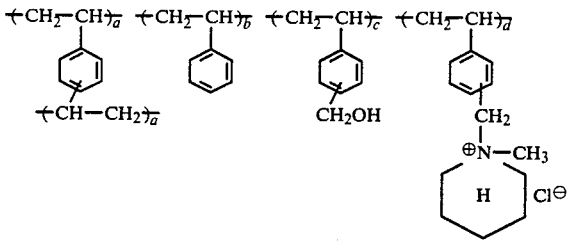

a:b:c:d = 5:47.5:5.5:42 (ratio by weight)

Compound B:

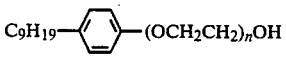

-continued n = about 30

Compound C:

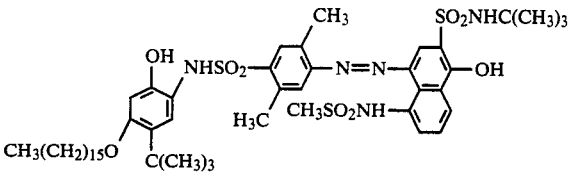

Compound D:

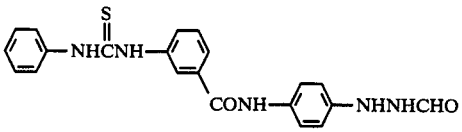

TABLE 7

| No. | Dye No. of Previous Addition | Amount (mol/mol AgX) | Dye No. of Subsequent Addition | Amount (mol/mol AgX) | Reversal Sensitivity | Maximum Density | Minimum Density |
|---|---|---|---|---|---|---|---|
| 1 (comparison) | (IIa-2) | $2.1 \times 10^{-4}$ | — | — | 91 | 2.26 | 0.23 |
| 2 (comparison) | (IIa-2) | $3.0 \times 10^{-4}$ | — | — | 100 (standard) | 2.26 | 0.23 |
| 3 (comparison) | — | — | (Ia-2) | $0.9 \times 10^{-4}$ | 74 | 2.10 | 0.22 |
| 4 (the present invention) | (IIa-2) | $2.1 \times 10^{-4}$ | (Ia-2) | $0.9 \times 10^{-4}$ | 127 | 2.30 | 0.22 |
| 5 (comparison) | (Ia-2) | $0.9 \times 10^{-4}$ | (IIa-2) | $2.1 \times 10^{-4}$ | 81 | 2.11 | 0.23 |

TABLE 8

| No. | Dye No. of Previous Addition | Amount (mol/mol AgX) | Dye No. of Subsequent Addition | Amount (mol/mol AgX) | Reversal Sensitivity | Maximum Density | Minimum Density |
|---|---|---|---|---|---|---|---|
| 1 (comparison) | (IIa-1) | $2.8 \times 10^{-4}$ | — | — | 87 | 2.24 | 0.23 |
| 2 (comparison) | (IIa-1) | $3.9 \times 10^{-4}$ | — | — | 100 (standard) | 2.24 | 0.23 |
| 3 (the present invention) | (IIa-1) | $2.8 \times 10^{-4}$ | (Ia-1) | $1.1 \times 10^{-4}$ | 117 | 2.28 | 0.22 |
| 4 (comparison) | (Ia-1) | $1.1 \times 10^{-4}$ | (IIa-1) | $2.8 \times 10^{-4}$ | 83 | 2.18 | 0.23 |

TABLE 9

| No. | Dye No. of Previous Addition | Amount (mol/mol AgX) | Dye No. of Subsequent Addition | Amount (mol/mol AgX) | Reversal Sensitivity | Maxiumum Density | Minimum Density |
|---|---|---|---|---|---|---|---|
| 1 (comparison) | (IIc-8) | $2.00 \times 10^{-4}$ | — | — | 98 | 2.10 | 0.24 |
| 2 (comparison) | (IIc-8) | $2.75 \times 10^{-4}$ | — | — | 100 (standard) | 1.90 | 0.26 |
| 3 (the present invention) | (IIc-8) | $2.00 \times 10^{-4}$ | (Ic-6) | $0.75 \times 10^{-4}$ | 120 | 2.10 | 0.24 |
| 4 (comparison) | (Ic-6) | $0.75 \times 10^{-4}$ | (IIc-8) | $2.00 \times 10^{-4}$ | 93 | 1.90 | 0.26 |

TABLE 10

| No. | Dye No. of Previous Addition | Amount (mol/mol AgX) | Dye No. of Subsequent Addition | Amount (mol/mol AgX) | Reversal Sensitivity | Maximum Density | Minimum Density |
|---|---|---|---|---|---|---|---|
| 1 (comparison) | (IIc-9) | $2.7 \times 10^{-4}$ | — | — | 100 (standard) | 2.13 | 0.25 |

TABLE 10-continued

| No. | Dye No. of Previous Addition | Amount (mol/mol AgX) | Dye No. of Subsequent Addition | Amount (mol/mol AgX) | Reversal Sensitivity | Maximum Density | Minimum Density |
|---|---|---|---|---|---|---|---|
| 2 (comparison) | (IIc-11) | $2.7 \times 10^{-4}$ | — | — | 91 | 2.14 | 0.25 |
| 3 (comparison) | — | — | (Ic-7) | $0.7 \times 10^{-4}$ | 63 | 2.06 | 0.27 |
| 4 (the present invention) | (IIc-9) | $2.0 \times 10^{-4}$ | (Ic-7) | $0.7 \times 10^{-4}$ | 123 | 2.14 | 0.25 |
| 5 (the present invention) | (IIc-11) | $2.0 \times 10^{-4}$ | (Ic-7) | $0.7 \times 10^{-4}$ | 117 | 2.16 | 0.25 |
| 6 (comparison) | (Ic-7) | $0.7 \times 10^{-4}$ | (IIc-9) | $2.0 \times 10^{-4}$ | 87 | 2.01 | 0.27 |
| 7 (comparison) | (Ic-7) | $0.7 \times 10^{-4}$ | (IIc-11) | $2.0 \times 10^{-4}$ | 81 | 1.95 | 0.26 |

From the results shown in Tables 7 to 10, the same conclusions as obtained in Example 1 above were also obtained in this example.

EXAMPLE 3

An inner latent image type emulsion was prepared in the same manner as in Example 1.

Then, a light-sensitive sheet, a cover sheet and a treating solution used for color diffusion transfer photographic sensitive materials were produced.

To a polyethylene terephthalate transparent base, the following (1) to (6) were applied in turn to produce the light-sensitive sheet.

Light-Sensitive Sheet (1) An image receiving layer containing 2.9 g/m$^2$ of an aqueous polymer latex of the earlier described Compound A, 3.1 g/m$^2$ of gelatin and 0.3 g/m$^2$ of a coating assistant (the earlier described Compound B).

(2) A white reflection layer containing 19.1 g/m$^2$ of titanium dioxide and 2.5 g/m$^2$ of gelatin.

(3) A light-shielding layer containing 2.0 g/m$^2$ of carbon black and 1.5 g/m$^2$ of gelatin.

(4) A layer containing 0.46 g/m$^2$ of a cyan dye releasing redox compound (the following Compound E), 0.08 g/m$^2$ of tricyclohexyl phosphate, 0.013 g/m$^2$ of 2,5-di-t-pentadecylhydroquinone and 0.77 g/m$^2$ of gelatin.

Compound E:

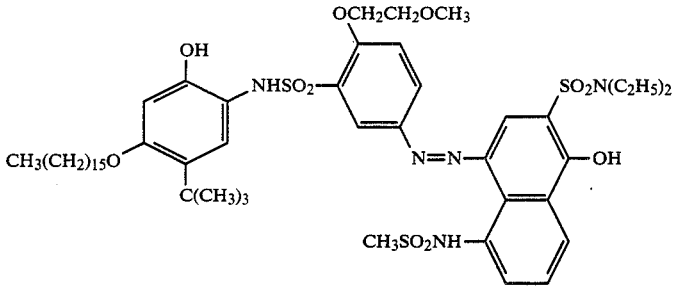

(5) A red-sensitive inner latent image type direct positive silver bromide emulsion layer having a silver content of 0.95 g/m$^2$ containing 1.2 g/m$^2$ of gelatin, 0.05 mg/m$^2$ of a nucleus forming agent (the earlier described Compound D) and 0.13 g/m$^2$ of 2-sulfo-5-n-pentadecylhydroquinone sodium salt, which was spectrally sensitized by adding a sensitizing dye represented by general formula (II) and thereafter adding a sensitizing dye represented by general formula (I) after the passage of 10 minutes (but in the case of comparison, the order of adding the dyes was reversed) as shown in Table 11 to Table 14.

(6) A layer containing 1.0 g/m$^2$ of gelatin.

The cover sheet was produced as follows.

Cover Sheet

To a transparent polyethylene terephthalate base, the following layers (1') to (3') were applied in turn to produce the cover sheet.

(1') A layer containing an 80:20 (ratio by weight) copolymer of acrylic acid and butyl acrylate (22 g/m$^2$) and 1,4-bis(2,3-epoxypropoxy)butane (0.44 g/m$^2$).

(2') A layer containing acetyl cellulose (which was prepared by hydrolyzing 100 g of acetyl cellulose so as to form 39.4 g of acetyl groups) (3.8 g/m$^2$), a methanol ring-opened product of a 60:40 (ratio by weight) copolymer of styrene and maleic acid anhydride (molecular weight: about 50,000) (0.23 g/m$^2$) and 5-(2-cyano-1-methylethylthio)-1-phenyltetrazole (0.154 g/m$^2$).

(3') A layer having a thickness of 2$\mu$, which was prepared by blending a 49.7:42.3:3:5 copolymer latex of styrene-n-butyl acrylate-acrylic acid-N-methylolacrylamide and a 93:4:3 (ratio by weight) copolymer latex of methyl methacrylate-acrylic acid-N-methylolacrylamide so as to have a solids content ratio of the former to the latter of 6:4.

After the above described light-sensitive sheet was imagewise exposed to light through a red filter, the above described cover sheet was put thereon and the same treating solution as was used in Example 2 was spread between both sheets to a thickness of 85$\mu$ (spreading was carried out by the aid of a press roll) and development was carried out at 25° C. The results of sensitometry measurements on the resultant reversal yellow images are shown in Table 11 to Table 14. The sensitivity of the reversal image is the reciprocal value of the exposure which produces a density corresponding to (maximum image density—0.3), which is represented by a relative value to the control sample (shown as standard in the tables).

TABLE 11

| No. | Dye No. of Previous Addition | Amount (mol/mol AgX) | Dye No. of Subsequent Addition | Amount (mol/mol AgX) | Reversal Sensitivity | Maximum Density | Minimum Density |
|---|---|---|---|---|---|---|---|
| 1 (comparison) | (IId-12) | $2.45 \times 10^{-4}$ | — | — | 87 | 1.82 | 0.36 |
| 2 (comparison) | (IId-12) | $3.55 \times 10^{-4}$ | — | — | 100 (standard) | 1.82 | 0.38 |
| 3 (comparison) | — | — | (Id-8) | $1.1 \times 10^{-4}$ | 50 | 0.80 | 0.34 |
| 4 (comparison) | — | — | (Id-8) | $3.55 \times 10^{-4}$ | 69 | 0.63 | 0.40 |
| 5 (the present invention) | (IId-12) | $2.45 \times 10^{-4}$ | (Id-8) | $1.1 \times 10^{-4}$ | 120 | 1.86 | 0.34 |
| 6 (comparison) | (Id-8) | $1.1 \times 10^{-4}$ | (IId-12) | $2.45 \times 10^{-4}$ | 79 | 1.74 | 0.36 |

TABLE 12

| No. | Dye No. of Previous Addition | Amount (mol/mol AgX) | Dye No. of Subsequent Addition | Amount (mol/mol AgX) | Reversal Sensitivity | Maximum Density | Minimum Density |
|---|---|---|---|---|---|---|---|
| 1 (comparison) | (IId-16) | $2.45 \times 10^{-4}$ | — | — | 85 | 1.79 | 0.38 |
| 2 (comparison) | (IId-16) | $3.55 \times 10^{-4}$ | — | — | 100 (standard) | 1.79 | 0.40 |
| 3 (comparison) | — | — | (Id-10) | $1.1 \times 10^{-4}$ | 43 | 0.69 | 0.34 |
| 4 (the present invention) | (IId-16) | $2.45 \times 10^{-4}$ | (Id-10) | $1.1 \times 10^{-4}$ | 135 | 1.80 | 0.37 |
| 5 (comparison) | (Id-10) | $1.1 \times 10^{-4}$ | (IId-16) | $2.45 \times 10^{-4}$ | 63 | 0.71 | 0.37 |

TABLE 13

| No. | Dye No. of Previous Addition | Amount (mol/mol AgX) | Dye No. of Subsequent Addition | Amount (mol/mol AgX) | Reversal Sensitivity | Maximum Density | Minimum Density |
|---|---|---|---|---|---|---|---|
| 1 (comparison) | (IIe-21) | $3.7 \times 10^{-4}$ | — | — | 100 (standard) | 1.80 | 0.34 |
| 2 (comparison) | (IIe-18) | $3.7 \times 10^{-4}$ | — | — | 85 | 1.81 | 0.34 |
| 3 (comparison) | — | — | (Ie-13) | $0.9 \times 10^{-4}$ | 52 | 1.01 | 0.35 |
| 4 (the present invention) | (IIe-21) | $2.8 \times 10^{-4}$ | (Ie-13) | $0.9 \times 10^{-4}$ | 117 | 1.78 | 0.34 |
| 5 (the present invention) | (IIe-18) | $2.8 \times 10^{-4}$ | (Ie-13) | $0.9 \times 10^{-4}$ | 112 | 1.79 | 0.34 |

TABLE 14

| No. | Dye No. of Previous Addition | Amount (mol/mol AgX) | Dye No. of Subsequent Addition | Amount (mol/mol AgX) | Reversal Sensitivity | Maximum Density | Minimum Density |
|---|---|---|---|---|---|---|---|
| 1 (comparison) | (IIg-30) | $2.83 \times 10^{-4}$ | — | — | 100 (standard) | 1.77 | 0.34 |
| 2 (comparison) | — | — | (Ig-20) | $1.0 \times 10^{-4}$ | 49 | 0.86 | 0.32 |
| 3 (comparison) | — | — | (Ig-23) | $1.0 \times 10^{-4}$ | 56 | 0.73 | 0.32 |
| 4 (the present invention) | (IIg-30) | $1.83 \times 10^{-4}$ | (Ig-20) | $1.0 \times 10^{-4}$ | 129 | 1.78 | 0.33 |
| 5 (the present invention) | (IIg-30) | $1.83 \times 10^{-4}$ | (Ig-23) | $1.0 \times 10^{-4}$ | 138 | 1.76 | 0.33 |
| 6 (comparison) | (Ig-20) | $1.0 \times 10^{-4}$ | (IIg-30) | $1.83 \times 10^{-4}$ | 54 | 0.89 | 0.33 |
| 7 (comparison) | (Ig-23) | $1.0 \times 10^{-4}$ | (IIg-30) | $1.83 \times 10^{-4}$ | 60 | 0.82 | 0.33 |

From the results shown in Tables 11 to 14, the same conclusions as obtained in Example 1 above were also obtained in this example.

While the invention has been described in detail and with reference to specific embodiments thereof, it will be apparent to one skilled in the art that various changes and modifications can be made therein without departing from the spirit and scope thereof.

What is claimed is:

1. An inner latent image type silver halide photographic emulsion which is spectrally sensitized by adding at least one cyanine sensitizing dye represented by general formula (II) to a direct positive inner latent image type silver halide photographic emulsion and thereafter adding additionally at least one cyanine sensitizing dye represented by general formula (I) to said emulsion:

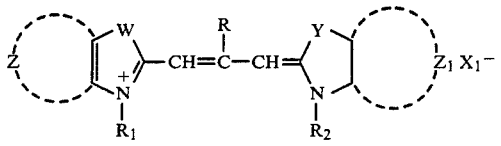

(I)

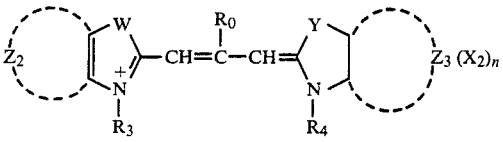

(II)

wherein W and Y which may be identical or different from each other each represents an oxygen atom, a selenium atom, a sulfur atom or $>N\text{-}R_5$, wherein $R_5$ represents a lower alkyl group which is unsubstituted or substituted with a halogen atom or a lower alkoxyl group or an allyl group, Z, $Z_1$, $Z_2$ and $Z_3$ each represents an atomic group necessary to form a benzene ring or naphthalene ring, R and $R_0$ each represents a hydrogen atom, a lower alkyl group, a phenyl group or an aralkyl group, $R_1$ and $R_2$ each represents an alkyl group, a haloalkyl group, an alkoxyalkyl group, an aralkyl group, an aryloxyalkyl group or an allyl group, $R_3$ and $R_4$ each represents an alkyl group substituted with a carboxyl group or a sulfo group, but at least one of $R_3$ and $R_4$ represents an alkyl group substituted with a sulfo group, $X_1$ represents an anion, $X_2$ represents an anion or a cation, and n is 0 or 1.

2. The silver halide photographic emulsion of claim 1, wherein Z, $Z_1$, $Z_2$ and $Z_3$ in formulae (I) and (II) each forms together with W, Y and the nitrogen atom a benzimidazole nucleus, a benzoxazole nucleus, a benzothiazole nucleus, a benzoselenazole nucleus, a naphthoxazole nucleus, a naphthothiazole nucleus or a naphthoselenazole nucleus.

3. The silver halide photographic emulsion of claim 1, wherein $R_3$ and $R_4$ in formula (II) include an alkyl group connected with a carboxyl group or a sulfo group through another divalent organic group.

4. The silver halide photographic emulsion of claim 1, wherein the sensitizing dyes represented by general formula (I) are selected from the group consisting of the following formulae (Ia-1), (Ia-2) and (Ia-3):

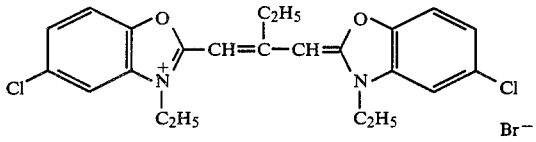

(Ia-1)

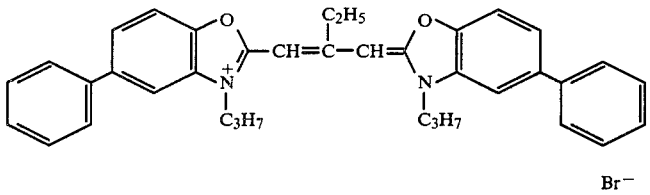

(Ia-2)

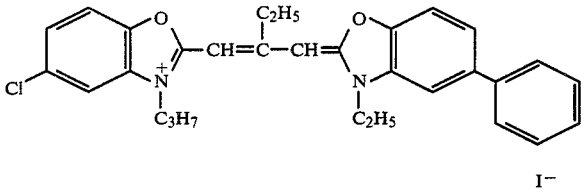

(Ia-3)

and the sensitizing dyes represented by formula (II) are selected from the group consisting of the following formulae (IIa-1), (IIa-2), (IIa-3) and (IIa-4):

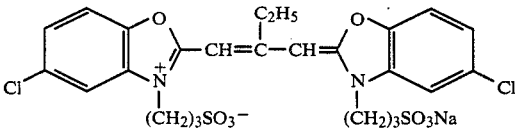

(IIa-1)

-continued (IIa-2)

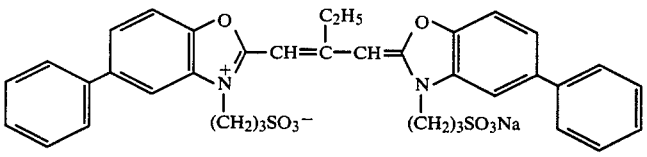

(IIa-3)

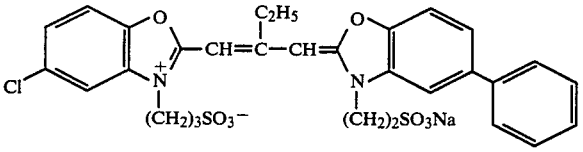

(IIa-4)

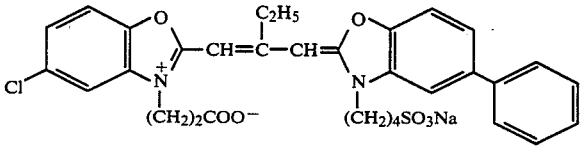

5. The silver halide photographic emulsion of claim 1, wherein the sensitizing dyes represented by general formula (I) are selected from the group consisting of the following formulae (Ic-6) and (Ic-7):

(Ic-6)

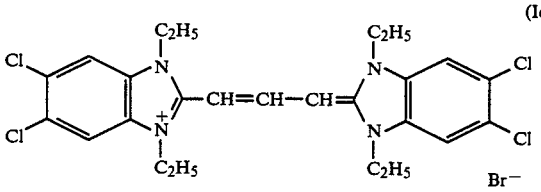

(Ic-7)

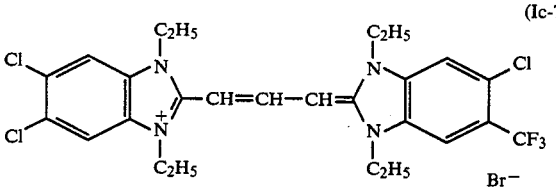

and the sensitizing dyes represented by general formula (II) are selected from the group consisting of the following formulae (IIc-8), (IIc-9), (IIc-10) and (IIc-11):

(Ic-8)

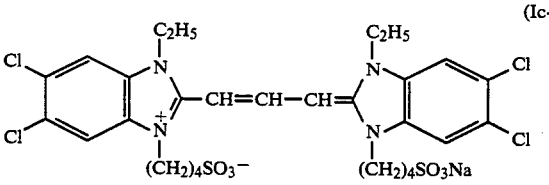

(Ic-9)

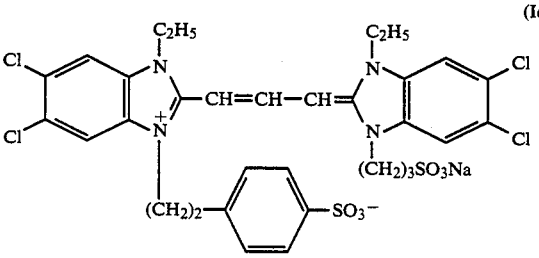

-continued (Ic-10)

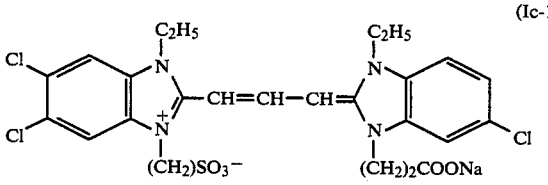

(Ic-11)

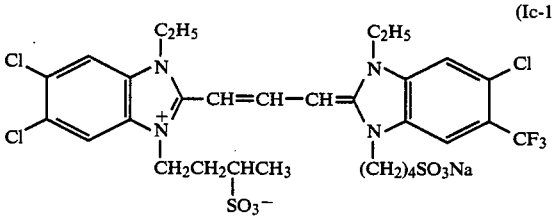

6. The silver halide photographic emulsion of claim 1, wherein the sensitizing dyes represented by general formula (I) are selected from the group consisting of the following formula (Id-8), (Id-9), (Id-10), (Id-11) and (Id-12):

(Id-8)

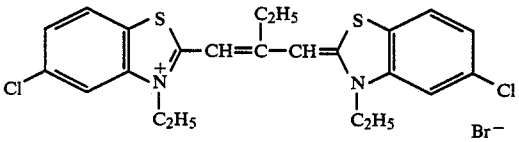

(Id-9)

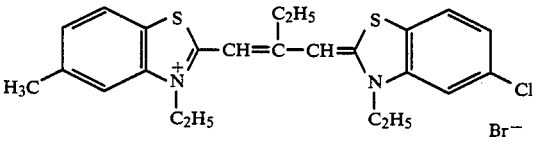

-continued (Id-10)

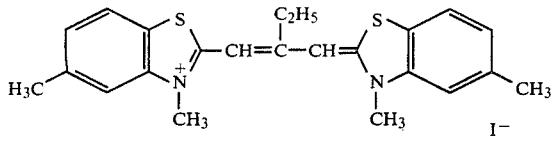

(Id-11)

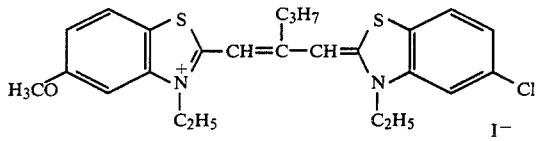

(Id-12)

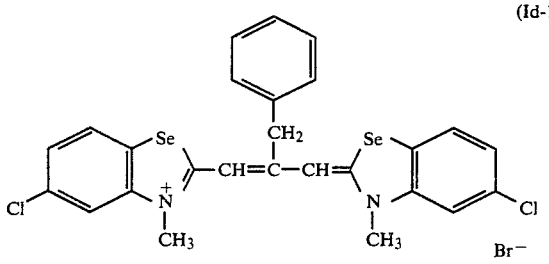

and the sensitizing dyes represented by general formula (II) are selected from the group consisting of the following formulae (IId-12), (IId-13), (IId-14), (IId-15), (IId-16) and (IId-17):

(IId-12)

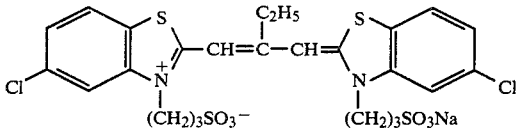

(IId-13)

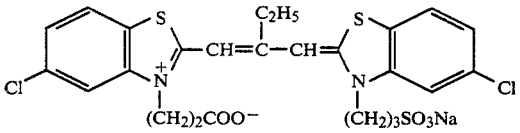

(IId-14)

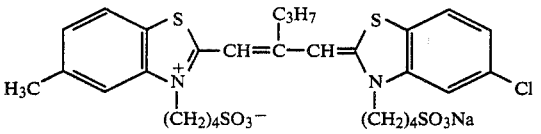

(IId-15)

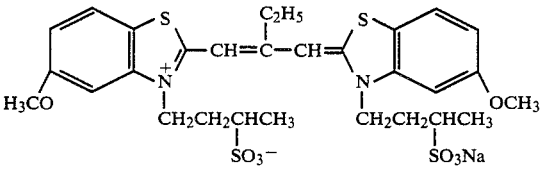

-continued (IId-16)

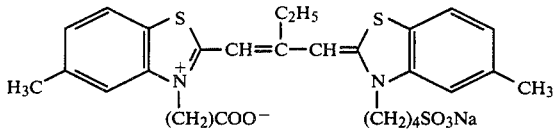

(IId-17)

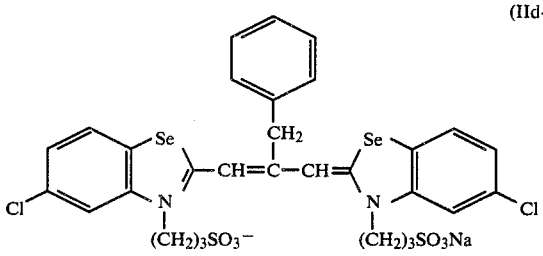

7. The silver halide photographic emulsion of claim 1, wherein the sensitizing dyes represented by general formula (I) are selected from the group consisting of the following formulae (Ig-19), (Ig-20), (Ig-21), (Ig-22), (Ig-23) and (Ig-24):

(Ig-19)

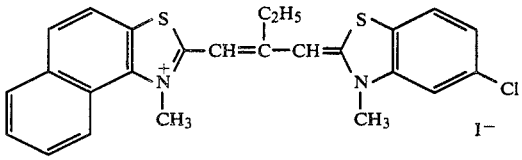

(Ig-20)

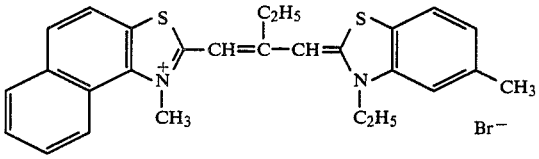

(Ig-21)

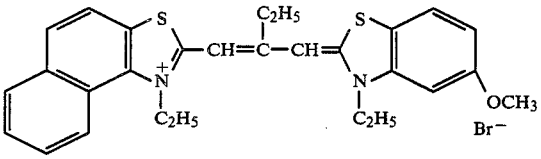

(Ig-22)

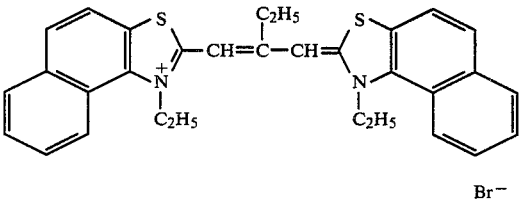

-continued (Ig-23)

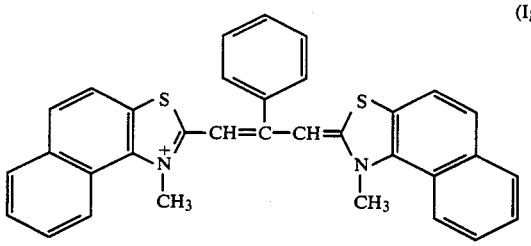

I⁻

(Ig-24)

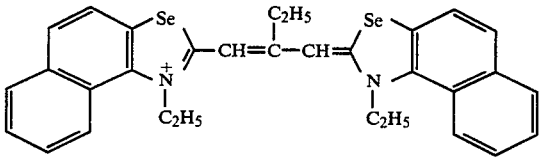

I⁻ and the sensitizing dyes represented by general formula (II) are selected from the group consisting of the following formulae (IIg-27), (IIg-28), (IIg-29), (IIg-30), (IIg-31) and (IIg-32):

(IIg-27)

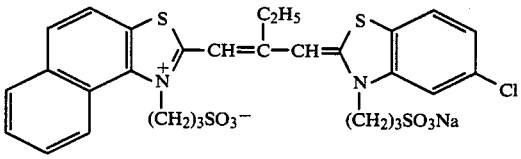

(IIg-28)

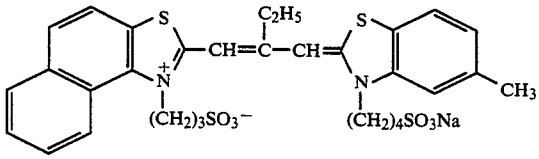

(IIg-29)

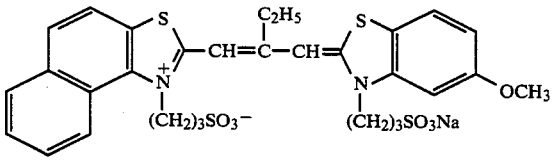

-continued (IIg-30)

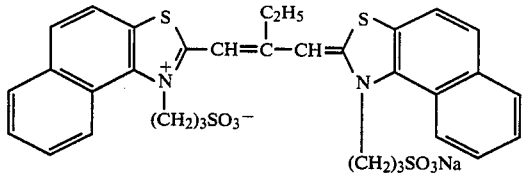

(IIg-31)

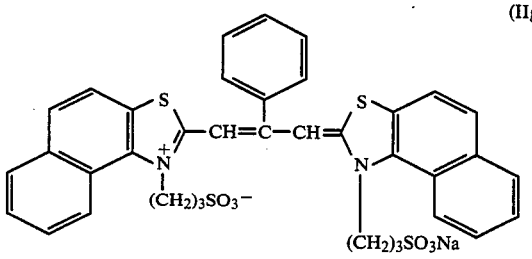

(IIg-32)

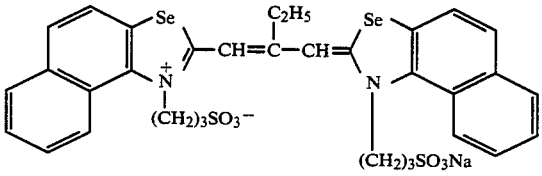

8. The silver halide photographic emulsion of claim 1, wherein the molar ratio of the sensitizing dyes represented by general formula (I) to the sensitizing dyes represented by general formula (II) is selected from a range of 1/20 to 20/1.

9. The silver halide photographic emulsion of claim 1, wherein the amount of each of the sensitizing dyes represented by general formulae (I) and (II) is from about $1.0\times10^{-5}$ to about $1.0\times10^{-3}$ mol per mol of silver halide.

10. The silver halide photographic emulsion of claim 1, wherein the time interval from the addition of the sensitizing dyes represented by general formula (II) to the addition of the sensitizing dyes represented by general formula (I) is at least 1 minute.

11. The silver halide photographic emulsion of claim 1, wherein the time interval from the addition of the sensitizing dyes represented by general formula (II) to the addition of the sensitizing dyes represented by general formula (I) is at least 5 minutes.

12. A silver halide photographic material capable of providing direct positive images by surface development in the presence of a nucleus forming agent after imagewise exposure to light which has at least one inner latent image type silver halide emulsion layer according to claim 1.

* * * * *